US009016512B2

(12) United States Patent
Ichikawa et al.

(10) Patent No.: US 9,016,512 B2
(45) Date of Patent: Apr. 28, 2015

(54) STORING CONTAINER

(75) Inventors: Toru Ichikawa, Tokyo (JP); Koki Abe, Tokyo (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 0 days.

(21) Appl. No.: 13/498,338

(22) PCT Filed: Sep. 27, 2010

(86) PCT No.: PCT/JP2010/005787

§ 371 (c)(1),
(2), (4) Date: Mar. 27, 2012

(87) PCT Pub. No.: WO2011/039986

PCT Pub. Date: Apr. 7, 2011

(65) Prior Publication Data

US 2012/0181276 A1 Jul. 19, 2012

(30) Foreign Application Priority Data

Oct. 2, 2009 (JP) ..... 2009-230225

(51) Int. Cl.

| | |
|---|---|
| ***B65D 81/02*** | (2006.01) |
| ***B65D 25/10*** | (2006.01) |
| ***A61J 1/03*** | (2006.01) |
| ***B65D 21/08*** | (2006.01) |

(52) U.S. Cl.
CPC ..... *B65D 25/101* (2013.01); *A61J 1/03* (2013.01); *B65D 21/08* (2013.01)

(58) Field of Classification Search
USPC ..... 215/231, 372, 376; 220/609, 611, 613, 220/625, 608, 628, 635, 636, 623, 630, 631, 220/729, 624
See application file for complete search history.

(56) References Cited

U.S. PATENT DOCUMENTS

| | | | | | |
|---|---|---|---|---|---|
| 2,982,440 | A | * | 5/1961 | Harrison | 220/609 |
| 3,143,243 | A | * | 8/1964 | MacKusick | 220/632 |
| 3,426,939 | A | * | 2/1969 | Young | 220/609 |
| 3,492,773 | A | * | 2/1970 | Bergstrom | 53/433 |
| 4,023,700 | A | * | 5/1977 | Buquet et al. | 220/592.25 |
| 5,096,078 | A | * | 3/1992 | McQueeny | 215/231 |
| 5,180,077 | A | * | 1/1993 | Lewis | 220/592.2 |

(Continued)

FOREIGN PATENT DOCUMENTS

| | | |
|---|---|---|
| EP | 0070776 A1 | 1/1983 |
| JP | 55-90571 | 6/1980 |

(Continued)

OTHER PUBLICATIONS

International Search Report received in corresponding PCT application No. PCT/JP2010/005787, dated Nov. 2, 2010 (2 pages).

(Continued)

*Primary Examiner* — Fenn Mathew
*Assistant Examiner* — Robert Stodola
(74) *Attorney, Agent, or Firm* — Osha Liang LLP

(57) ABSTRACT

A storing container has a container body having a storage part and a bottom, the storage part having an opening in a distal end of the storage part, the bottom closing a basal end portion of the storage part, and a lid closing the opening in the distal end of the storage part. The storage part is made of a plastic film. The bottom is deformable between a first state and a second state. The bottom is convex in a direction from the distal end of the storage part to a basal end of the storage part in the first state.

4 Claims, 8 Drawing Sheets

(56) References Cited

U.S. PATENT DOCUMENTS

2007/0199915 A1* 8/2007 Denner et al. ..... 215/375
2011/0253713 A1* 10/2011 Ichikawa et al. ..... 220/62.11

FOREIGN PATENT DOCUMENTS

JP 9-118366 A 5/1997
JP 2008-161513 A 7/2008
WO 2007/123194 A1 11/2007

OTHER PUBLICATIONS

International Search Report and Written Opinion received in corresponding PCT application No. PCT/JP20110/005787, dated May 8, 2012 (5 pages).
Office Action Issued in German Application No. 112010003906.2, Dated Aug. 20, 2013 (10 Pages with English Translation).

* cited by examiner

STORING CONTAINER

BACKGROUND OF THE INVENTION

1. Field of the Invention

The present invention relates to a storing container suitable for storing tablets of medicine and dietary supplements or the like, granular materials such as capsules and powder materials such as microcapsules.

2. Description of the Related Art

In general, tables of medicine are stored in containers such as glass bottles. When a container storing the tablets is transported, density of tablets is increased due to vibrations during transportation, and as a result, a space is created in an upper end portion inside the container. In this condition, tablets may move relative to each other and collide with or graze with each other. This may cause inconveniences such as the tablets being broken or fine powders being produced as a result of surfaces of the tablets being abraded.

To avoid such inconveniences, a foam having delayed shape recovery properties is disposed in a bottom of a container in the storing container disclosed in the Patent Document 1 given below. When a space starts to be created in an upper portion of the container, the foam expands to fill the space. Therefore, no space is created inside the container, thereby preventing tablets from colliding or grazing with each other.

PRIOR ART DOCUMENTS

Patent Documents

Patent Document 1: Japanese Unexamined Patent Application Publication No. H09-118366.

SUMMARY OF THE INVENTION

Problem to be Solved by the Invention

The foam used in the conventional container has the delayed shape recovery properties. Therefore, in a case where a space is created in the upper portion of the container immediately after the tablets are filled into the container, the space cannot be filled by the foam. For example, when the container is transported along a conveyor line immediately after the tablets are filled into the container, a space may be created in the upper portion of the container due to vibrations during transportation. However, the foam is not expanded immediately after the foam is inserted in the container. Accordingly, when a space is created inside the container immediately after the tablets are filled into the container, the space cannot be filled by the foam. Therefore, the container having the tablets filled therein is transported along a manufacturing line with the space created inside of the container. This may result in undesirable outcomes such as tablets being broken or fine powders being produced as a result of tablets being abraded due to vibrations during transportation.

Solution to the Problem

To solve the problem described above, the present invention provides a storing container comprising: a container body comprising a storage part and a bottom, the storage part having an opening in a distal end of the storage part, the bottom closing a basal end portion of the storage part; and a lid closing the opening in the distal end of the storage part, wherein the bottom is deformable between a first state and a second state, the bottom being convex in a direction from the distal end of the storage part to a basal end of the storage part in the first state, the bottom being convex in a direction from the basal end of the storage part to the distal end of the storage part in the second state and that the storing container further comprises a shape-maintaining means maintaining the bottom in the second state with a force of a predetermined magnitude.

In this case, it is preferable that the bottom is made of a plastic film, the shape-maintaining means is a shape-maintaining member fixed to an inner circumference of the basal end portion of the storage part, the basal end portion of the storage part being closer to the basal end of the storage part than the bottom, and the bottom is maintained in the second state by an abutment of the shape-maintaining member against the bottom. The shape-maintaining member may be deformable between the first state and the second state. Moreover, the shape-maintaining member may be integrally disposed in one of a surface of the bottom on the distal end side and a surface of the bottom on the basal end side.

The bottom may be elastically deformable between the first state and the second state and the bottom may also serve as a shape-maintaining means that can maintain itself in the second state by its own strength.

The shape-maintaining means may be a negative pressure formed inside the container body and the bottom may be deformed from the first state to the second state by the negative pressure. In this case, it is preferable that the storing part has a greater strength than the bottom so that the storing part may not be deformed by the negative pressure.

Advantageous Effects of the Invention

When granular materials, for example, are filled into the storing container of the present invention having the above-described features, a predetermined amount of the granular materials are put into the container body with the bottom being in the first state. After that, the container body is immediately vibrated to increase the density of the granular materials in the container body. As a result, a space having a volume corresponding to an amount of increase in the density of the granular materials is created inside the container body. Then, the bottom is made to be in the second state. This causes an internal volume of the container body to be reduced by an amount corresponding to a change of the state of the bottom from the first state to the second state. This also causes an entirety of the granular materials to be pressed to be moved toward the distal end of the container body. As a result, the space created inside the container body is filled by the granular materials. Moreover, since the bottom is maintained in the second state by the shape-maintaining means, no space is created inside the container body. Therefore, even when the container body is vibrated immediately after the granular materials are put into the container body, the granular materials will not be broken or fine powders will not be produced because the granular materials will not be abraded. Moreover, since the density of the granular materials is already increased by vibrating the container body, even if the container filled with the granular materials is vibrated during transportation after the completion of the manufacturing, no space will be created inside the container. Thus, the granular materials can be surely prevented from being broken and the fine powders can be surely prevented from being produced during the transportation of the finished products as well as during the conveyance of the container immediately after the filling of the granular materials into the container body.

DESCRIPTION OF THE PREFERRED EMBODIMENTS

Best modes for carrying out the invention will be described hereinafter with reference to the drawings.

Figure 1:
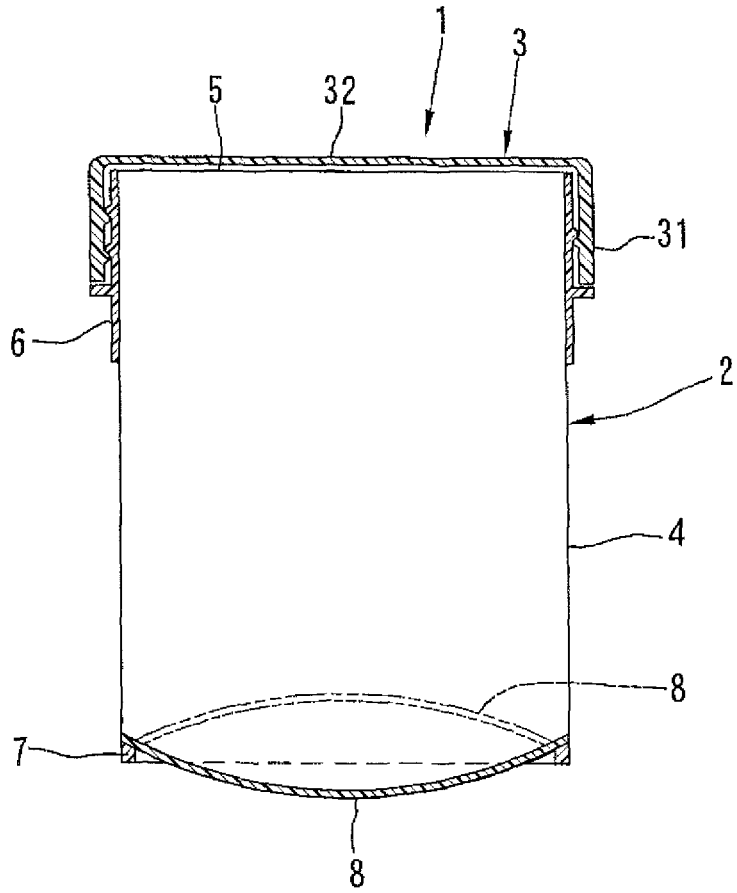
FIG. 1 is a vertical sectional view of a first embodiment of the present invention.
Figure 2:
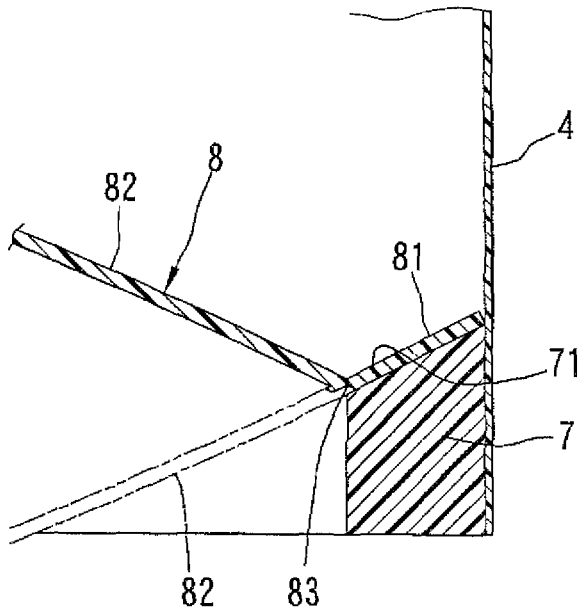
FIG. 2 is an enlarged cross-sectional view of a main portion of the first embodiment of the present invention.

FIGS. 1 and 2 depict a first embodiment of the present invention. A storing container for granular materials (storing container) 1 of this embodiment includes a container body 2 and a lid 3.

The container body 2 includes a storage part 4, a seal 5, a reinforcement cylinder 6, a reinforcement ring 7 and a bottom 8.

The storage part 4 has a cylindrical configuration having openings in an upper end (distal end) thereof and a lower end (basal end) thereof and having a circular cross-section. The storage part 4 is made of a plastic film. The plastic film can be a single-layer plastic film, but preferably, the plastic film is a laminated film or a co-extruded multilayer film.

The laminated film suitable for making the storage part 4 includes two base layers and a middle layer between the base layers. When the reinforcement cylinder 6 and the reinforcement ring 7 are injection molded, the base layer is composed of a plastic film that allows the storage part 4 to be welded onto the reinforcement cylinder 6 and the reinforcement ring 7 at the same time with the injection molding of the reinforcement cylinder 6 and the reinforcement ring 7. When the reinforcement cylinder 6 and the reinforcement ring 7 are formed and then the storage part 4 is joined to the reinforcement cylinder 6 and the reinforcement ring 7 with an adhesive, a film for the base layer is selected based on the compatibility of adhesion properties. Typically, the plastic film suitable for the base layer may be a nonoriented film. The nonoriented film may be composed of polyolefin such as low density polyethylene, medium density polyethylene, high density polyethylene, linear low density polyethylene and polypropylene, or blended resin of these polyolefins, ionomer resin, copolymer of ethylene and acrylic acid ester or methacrylic acid ester, such as ethylene-vinyl acetate copolymer, ethylene-acrylic acid copolymer, ethylene-methyle metacrylate copolymer, ethylene-acrylic acid copolymer and ethylene-methacrylic acide copolymer, polymethylpentene, polybutene, biodegradable polyester resin (for example, hydroxycarboxylic acid condensate such as polyactic acid and condensate of diol such as polybuthylene succinate and dicarboxylic acid. Alternatively, co-extruded multilayer film, an engineering plastic or a super engineering plastic having a heat-sealable resin layer disposed in a sealing surface may be used as necessary. A thickness of the base layer may be selected in a range of 10 to 200 μm, preferably selected in a range of 15 to 100 μm.

The middle layer includes a substrate layer and/or a functional layer. Preferably, a plastic film having a high physical strength such as a high piercing strength, a high tensile strength and a high impact strength and a high printability is selected for the substrate layer. Such a film may include a film made of synthetic resin based on polyester, polyamide, polypropylene, polyvinyl, ethylene-vinylalcohol copolymer, polycarbonate or polyacetal, or a coextruded multilayer film comprising such synthetic resins, for example. The film may be a nonoriented film or an oriented film oriented uniaxially or biaxially. In view of the printability, the film used for the substrate layer preferably is an oriented film oriented uniaxially or biaxially. Specifically, the film may be an oriented plastic film comprising biaxially oriented polyethylene terephthalate (PET), biaxially oriented polyamide (ONY), biaxially oriented polypropylene (OPP) or the like. Synthetic paper, cellophane, paper, nonwoven fabric or the like or engineering plastic or super engineering plastic may be used as the film for the substrate layer according to need. A thickness of the substrate layer may be selected in a range of 6 to 100 μm, preferably selected in a range of 12 to 30 μm.

A material for the functional layer may be selected as appropriate according to required properties such as gas barrier property, stiffness, flex resistance, piercing resistance, impact resistance, wear resistance, low-temperature resistance, heat resistance and chemical resistance. A film suitable for the functional layer may comprise a metal foil comprising aluminum, iron, copper, or magnesium or the like. Alternatively, the film may comprise a film comprising polyethylene terephthalate, polyamide, polyvinyl chloride, polycarbonate, polyvinyl alcohol or ethylene-vinyl alcohol copolymer, which may be or may not be coated with polyvinylidene chloride, or may be or may not be vapor-deposited with an inorganic substance such as aluminum, silicon oxide, aluminum oxide and magnesium oxide. Alternatively, the film may be a film comprising polyvinyl chloride or the like, nonwoven fabric or a foamed film or the like having heat resistance, an engineering plastic or a super engineering plastic having high heat resistance and high solvent resistance. The functional layer may be a single-layer or a multiple-layer. The functional layer may have any thickness as far as the functional layer satisfies required functions. Preferably, the thickness of the functional layer may be in a range of 6 to 30 μm.

The coextruded multilayer film typically comprises three to seven layers. One example of the coextruded multilayer film is a three-layer film composed of linear low-density polyethylene (LLDPE), polyamide (NY) and linear low-density polyethylene (LLDPE), layered from one surface to the other surface in this order. Another example of the coextruded multilayer film is a five-layer film composed of linear low-density polyethylene (LLDPE), polyamide (NY), ethylene-vinylalcohol copolymer (EVOH), polyamide (NY) and linear low-density polyethylene (LLDPE).

The storage part 4 may be manufactured by rolling a material comprising a plastic film or a membrane into a cylindrical configuration, and then fixing together opposite end portions of the material in a circumferential direction thereof. When the storage part 4 is made of a laminated film, one of the two base layers is disposed on an outer side and the other of the two base layers is disposed on an inner side. As a result, an outer circumferential surface of the storage part 4 is composed of an outer surface of the one of the base layers and an inner circumferential surface of the storage part 4 is composed of an outer surface of the other of the base layers. Alternatively, the storage part 4 may be formed by blow molding or other molding methods to avoid formation of seams.

It is not required to make the storage part 4 out of plastics. The storage part 4 may be made of a rigid material such as glass. It is not required that the storage part 4 has a circular cross-sectional configuration. The storage part 4 may have a polygonal or other cross-sectional configuration. The cross-sectional configuration of the storage part 4 may be varied along a longitudinal direction of the storage part 4. Moreover, it is not required that inner and outer diameters of the storage part 4 should be constant throughout the entire length of the storage part 4. A diameter of the upper end opening of the storage part 4 and a portion adjacent to the upper end opening may be smaller than lower portion of the storage part 4. Such modifications may be made in combination with each other as appropriate.

The upper end opening of the storage part 4 is air-tightly sealed by the seal 5. The seal 5 is made of a plastic film. The plastic film may be a single-layer film. However, it is preferable that the plastic film is a laminated film having a metal layer comprising an aluminum foil or the like in the middle layer. Typically, the seal 5 is made of a film similar to the film used for the functional layer of the laminated film constituting the storage part 4. An outer circumferential portion of an under surface of the seal 5 is fixed to an upper end surface of the storage part 4 and an upper end surface of the reinforcement cylinder 6 to be described below, thereby air-tightly closing the upper end opening of the storage part 4.

The reinforcement cylinder 6 is made of relatively hard plastics molded into a cylindrical configuration. The reinforcement cylinder 6 is fitted to an upper end portion of the outer circumferential surface of the storage part 4 and fixed by fixing means such as adhesion or welding. Particularly in this embodiment, since the reinforcement cylinder 6 is formed by insert molding, the reinforcement cylinder 6 is allowed to be welded to the storage part 4 at the same time as the reinforcement cylinder 6 is formed. For this purpose, a plastic constituting the reinforcement cylinder 6 is selected from the plastic films suitable for the base layer of the laminated film constituting the storage part 4 mentioned above. Particularly, a plastic that can be welded to the base layer may be adopted. The reinforcement cylinder 6 has a predetermined strength that is strong enough to maintain its own shape. Therefore, the upper end portion of the storage part 4 is also maintained in a certain configuration, i.e., the circular cross-section by the reinforcement cylinder 6 being fixed to an upper end portion of the storage part 4. The upper end surface of the reinforcement cylinder 6 is disposed coplanar with the upper end surface of the storage part 4. The seal 5 is fixed on the upper end surface of the reinforcement cylinder 6. It is to be understood that the seal 5 is fixed to the storage part 4 and the reinforcement cylinder 6 after granular materials (not shown) or powder materials (not shown) are filled into the storage part 4.

The lid 3 is threadedly secured to an outer circumferential surface of the reinforcement cylinder 6. The lid 3 is made of relatively hard plastics or metal. Plastics suitable for the lid 3 include all of the polyethylenes including high density polyethylene (HDPE), medium-density polyethylene (MDPE) and low-density polyethylene (LDPE), polypropylene (PP), polyvinyl chloride (PVC), polyvinyliden chloride (PVDC), polystyrene (PS), polyvinyl acetate (PVA), acrylonitrile-butadiene-styrene copolymer (ABS), acrylonitrile-styrene copolymer (AS), polymethylmethacrylate (PMMA), engineering plastic and superengineering plastic. The lid 3 includes a cylindrical part 31 and a top plate part 32. The cylindrical part 31 is threadedly engaged with the outer circumferential surface of the reinforcement cylinder 6. The top plate part 32 closes an upper end opening of the cylindrical part 31. The lid 3 is removably fastened to the reinforcement cylinder 6 by threadedly engaging the cylindrical part 31 with an upper end portion of the reinforcement cylinder 6 and fastening the cylindrical part 31. In a fastened state, an under surface of the top plate part 32 of the lid 3 generally contacts a top surface of the seal 5. The lid 3 may be removably fastened to the reinforcement cylinder 6 in other fastening methods. The lid 3 fastened to the reinforcement cylinder 6 closes the opening of the storage part 4. Therefore, when the lid 3 can air-tightly seal the upper end opening of the storage part 4, the seal 5 may be omitted. The lid 3 threadedly fastened to the reinforcement cylinder 6 covers the seal 5. Accordingly, the seal 5 is protected by the lid 3 from being broken by external factors such as by being collided with objects.

The reinforcement ring 7 is made of relatively hard plastics molded into a ring configuration. The reinforcement ring 7 is fitted to a lower end portion of the inner circumferential surface of the storage part 4 and fixed by fixing means such as adhesion or welding. Particularly in this embodiment, since the reinforcement ring 7 is formed by insert molding, the reinforcement ring 7 is allowed to be welded to the storage part 4 at the same time as the reinforcement ring 7 is formed. For this purpose, a plastic constituting the reinforcement ring 7 is selected from the plastic films suitable for the base layer of the film constituting the storage part 4 mentioned above. Particularly, a plastic that can be welded to the base layer may be adopted. A lower end surface of the reinforcement ring 7 is disposed coplanar with a lower end surface of the storage part 4. The reinforcement ring 7 has a predetermined strength that is strong enough to maintain its own shape. Therefore, the lower end portion of the storage part 4 is also maintained in a certain configuration, i.e., the circular cross-section by the reinforcement ring 7 being fixed to a lower end portion of the storage part 4. Since the upper and lower end portions of the storage part 4 are respectively maintained in the circular cross-sectional configuration by the reinforcement cylinder 6 and the reinforcement ring 7 as mentioned above, the storage part 4 can be maintained in a certain shape when placed on a horizontal surface even when the storage part 4 is made of a laminated material having poor shape retention.

The bottom 8 may be made of resins such as plastics. Materials suitable for the bottom 8 include the plastics suitable for the lid 3. In addition to them, natural rubber and synthetic rubber are also suitable. The bottom 8 is made by forming such materials into a plate configuration. An outer circumferential portion of an under surface of the bottom 8 is fixed to a top surface 71 of the reinforcement ring 7 by adhesion or other means. Specifically, the top surface 71 of the reinforcement ring 7 is formed as a tapered surface tapered such that an outer circumferential portion of the top surface 71 is higher than an inner circumferential portion of the top surface 71. An outer circumferential portion 81 of the bottom 8 is also formed into a tapered configuration corresponding to the tapering of the top surface 71. However, when the top surface 71 of the reinforcement ring 7 is formed as a horizontal surface, the outer circumferential portion 81 of the bottom 8 also is formed in a horizontal flat plate configuration.

A portion of the bottom 8 located further inside than the reinforcement ring 7 is a convexly-curved plate portion 82. The convexly-curved plate portion 82 is composed of a portion of an imaginary spherical shell. The convexly-curved plate portion 82 is disposed such that a center thereof is located on an axis of the storage part 4. The convexly-curved plate portion 82 is elastically deformable between an upwardly convex state (second state) as indicated in solid lines in FIG. 2 and a downwardly convex state (first state) as indicated in solid lines in FIG. 1. Particularly in this embodiment, a notch 83 is formed in the under surface of the bottom 8 in an annular configuration. The notch 83 is disposed at a boundary of the outer circumferential portion 81 and the convexly-curved plate portion 82. The notch 83 allows the convexly-curved plate portion 82 to be easily elastically deformed between the downwardly convex state and the upwardly convex state. Moreover, the convexly-curved plate portion 82 has enough strength to maintain itself in the upwardly convex state with a force of a predetermined magnitude. This means that the convexly-curved plate portion 82 in the upwardly convex state has strength enough to maintain itself in the upwardly convex state without being elastically deformed into the downwardly convex state by a weight of granular materials filled into the storage part 4. Moreover, the convexly-curved plate portion 82 in the upwardly convex state has strength enough not to be elastically deformed into the downwardly convex state by an downward acceleration (downward force) acting on the granular materials due to vibrations even if the container 1 is vibrated in the vertical direction during ordinary transportation. In this way, the bottom 8 that closes the lower end portion of the storage part 4 also serves as a shape-maintaining means that maintains itself in the upwardly convex state with the force of the predetermined magnitude.

When granular materials such as medicine tablets are filled into the container for granular materials 1 having the above-mentioned features, the upper end opening of the container body 2 (storage part 4) is opened and the bottom 8 is made to be in the downwardly convex state in advance. Then a predetermined amount of the granular materials are put into the storage part 4 from the upper end opening of the storage part 4. For example, the granular materials are put into the storage part 4 until the granular materials located on top are generally coplanar with the top end surface of the storage part 4. After that, the storage part 4 is vertically vibrated. This increases a density of the granular materials, and a height of the granular materials located on top becomes lower than a top end of the storage part 4 by a height corresponding to the increase in the density of the granular materials, thereby creating a space in an upper portion of the storage part 4. The convexly-curved plate portion 82 is designed such that a volume of a space defined by the convexly-curved plate portion 82 in the downwardly convex state and the convexly-curved plate portion 82 in the upwardly convex state is generally equal to the volume of the space created in the upper portion of the storage part 4. Therefore, when the convexly-curved plate portion 82 in the downwardly convex state is deformed into the upwardly convex state, the entire granular materials filled into the storage part 4 are moved upward and the granular materials located on top become coplanar with the top end of the storage part 4. After that the seal 5 is fixed to the upper end surfaces of the storage part 4 and the reinforcement cylinder 6, and the lid 3 is threadedly secured to the reinforcement cylinder 6. This completes the manufacturing of the container 1 filled with the granular materials.

In the container 1 filled with the granular materials in the method described above, the density of the granular materials is increased by vibrating the storage part 4 immediately after filling the granular materials into the storage part 4, and then the bottom 8 is elastically deformed from the downwardly convex state to the upwardly convex state, thereby making the granular materials located on top generally coplanar with the top end of the storage part 4. Therefore, when the top end opening of the storage part 4 is sealed by the seal 5 and the lid 3 is threadedly secured, no space is created between the granular materials located on top and the seal 5. The granular materials are prevented from being relatively moved by the bottom 8 and the lid 3 (lid 3 via the seal 5). Thus, the granular materials can be prevented from being broken and surfaces of the granular materials can be prevented from being abraded and causing fine powders to be produced. Moreover, since the density of the granular materials filled into the storage part 4 is increased immediately after the granular materials are filled into the storage part 4, the density of the granular materials is not increased and the space is not created inside the storage part 4 between the granular materials located on top and the seal 5 later on by vibrations during transportation. Thus, the granular materials can be prevented from being broken and the fine powders can be prevented from being produced during ordinary transportation as well as during manufacturing.

Other embodiments of the present invention will be described hereinafter. In the embodiments described below, only features different from those of the first embodiment will be described. The same components are denoted by the same reference signs and a detailed description thereof is omitted.

Figure 3:
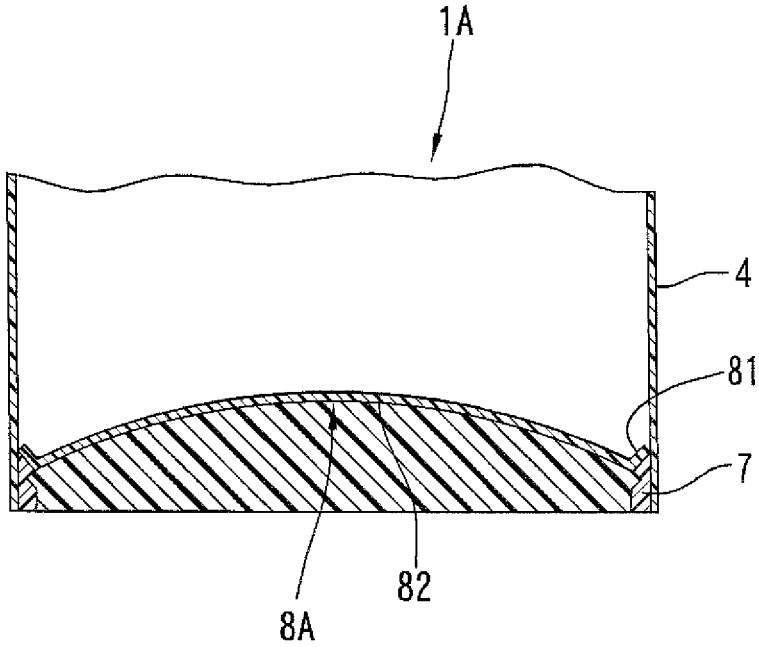
FIG. 3 is a vertical sectional view of a part of a second embodiment of the present invention.
Figure 4:
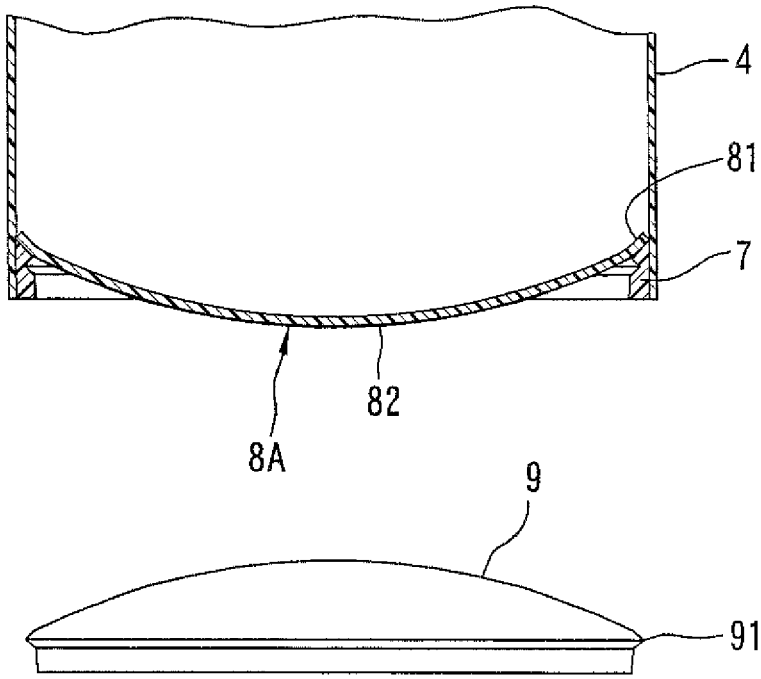
FIG. 4 is a vertical sectional view of the part of the second embodiment of the present invention, with a shape-maintaining member separated from a container body.
Figure 5:
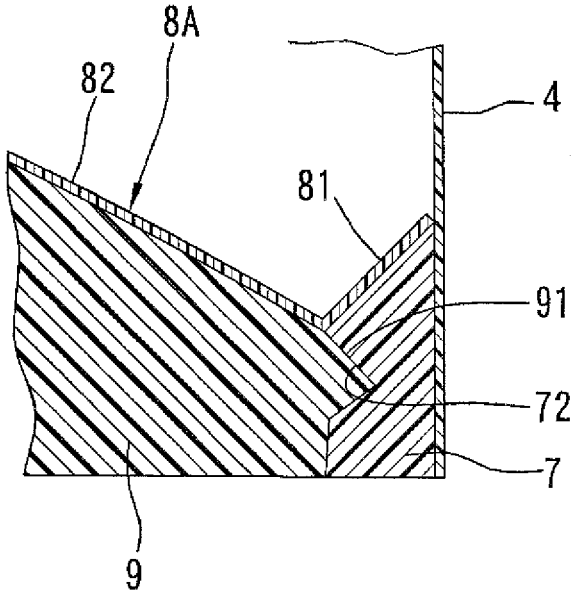
FIG. 5 is an enlarged cross-sectional view of a main portion of the second embodiment of the present invention.

FIGS. 3 to 5 illustrate a second embodiment of the present invention. In the container for granular materials 1A of this embodiment, a bottom 8A is used instead of the bottom 8. The bottom 8A is composed of a single-layer plastic film or a laminated plastic film. In this embodiment, the bottom 8A is composed of a laminated film similar to the laminated film constituting the storage part 4. Accordingly, the bottom 8A is deformable between a downwardly convex state and an upwardly convex state. However the bottom 8A does not have strength enough to maintain itself in the upwardly convex state. So, a shape-maintaining member (shape-maintaining means) 9 that maintains the bottom 8A in the upwardly convex state is used.

The shape-maintaining member 9 has a discoid shape. An outer circumferential surface of the shape-maintaining member 9 insertably fitted into an inner circumferential surface of the reinforcement ring 7. An engagement protrusion 91 is formed in the outer circumferential surface of the shape-maintaining member 9 in an annular configuration. The engagement protrusion 91 is fitted into an engagement recess 72 formed in the inner circumferential surface of the reinforcement ring 7 in an annular configuration, thereby securing the shape-maintaining member 9 to the reinforcement ring 7. A top surface of the shape-maintaining member 9 is formed into a same shape as an under surface of the bottom 8A in the upwardly convex state. A top surface of the shape-maintaining member 9 is in touch with the under surface of the bottom 8A without gap.

When the granular materials are filled into the container 1A having the above-mentioned features, the shape-maintaining member 9 is removed from the reinforcement ring 7 in advance, thereby making the bottom 8 in the downwardly convex state. Then a predetermined amount of the granular materials are put into the storage part 4 from the upper end opening of the storage part 4. After that, the storage part 4 is vibrated. Then the shape-maintaining member 9 is inserted into the reinforcement ring 7 from a lower end opening of the reinforcement ring 7 until the engagement protrusion 91 is fitted into the engagement recess 72. This causes the convexly-curved plate portion 82 of the bottom 8 to be transformed from the downwardly convex state to the upwardly convex state and to be maintained in the upwardly convex state. After that, the upper end opening of the storage part 4 is closed by the seal 5 and the lid 3 as with the first embodiment. In this embodiment, the lid 3 contacts the granular materials via the seal 5 and the shape-maintaining member 9 contacts the granular materials via the bottom 8A. The granular materials are held by the lid 3 and the shape-maintaining member 9 therebetween. To prevent this holding force from being excessively strong in a portion of the shape-maintaining member 9, in other words, to make the holding force acting on each of the granular materials contacted by the shape-maintaining member 9 via the bottom 8A as equal as possible, it is preferable that at least a top surface of the force-maintaining member 9 contacted with the bottom 8A has some elasticity.

Figure 6:
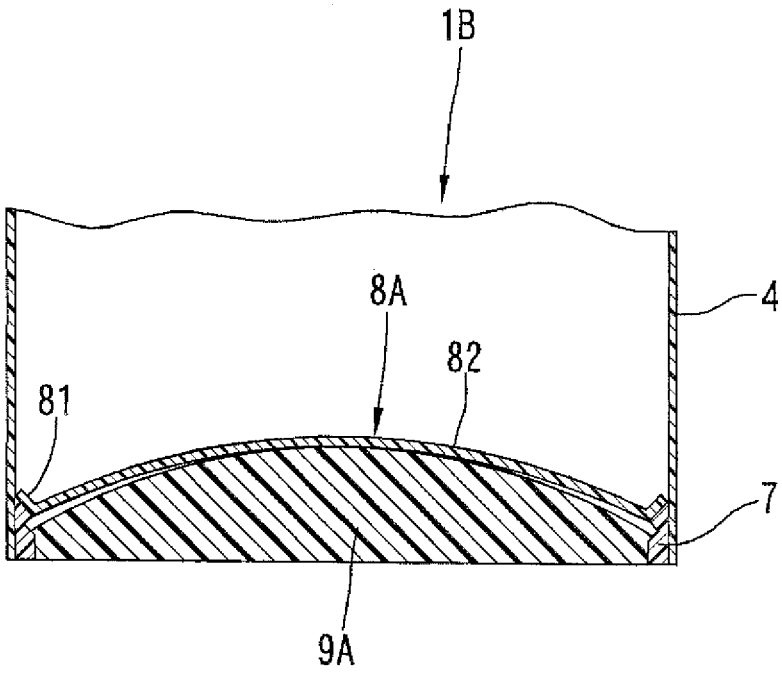
FIG. 6 is a vertical sectional view of a part of a third embodiment of the present invention.

FIG. 6 illustrates a third embodiment of the present invention. In a container for granular materials 1B of this embodiment, a shape-maintaining member 9A is used instead of the shape-maintaining member 9. A radius of curvature of a top surface of the shape-maintaining member 9A is slightly smaller than a radius of curvature of an under surface of the convexly-curved plate portion 82 of the bottom 8. As a result, while a central portion of the upper surface of the shape-maintaining member 9A is in contact with a central portion of the convexly-curved plate portion 82, a peripheral portion of the top surface of the shape-maintaining member 9A is slightly downwardly spaced from the convexly-curved plate portion 82. An annular gap is formed between the shape-maintaining member 9A and the convexly-curved plate portion 82. As is clear from this, it is not required that the entirety of the top surface of the shape-maintaining member 9A is contacted with the bottom 8A. A portion of the top surface of the shape-maintaining member 9A may be spaced from the bottom 8A in the vertical direction. The top surface of the shape-maintaining member 9A may be formed in a stepped configuration in which a central portion of the top surface is higher than a peripheral portion of the top surface. This feature can also be adopted in fourth to seventh embodiments to be described below.

Figure 7:
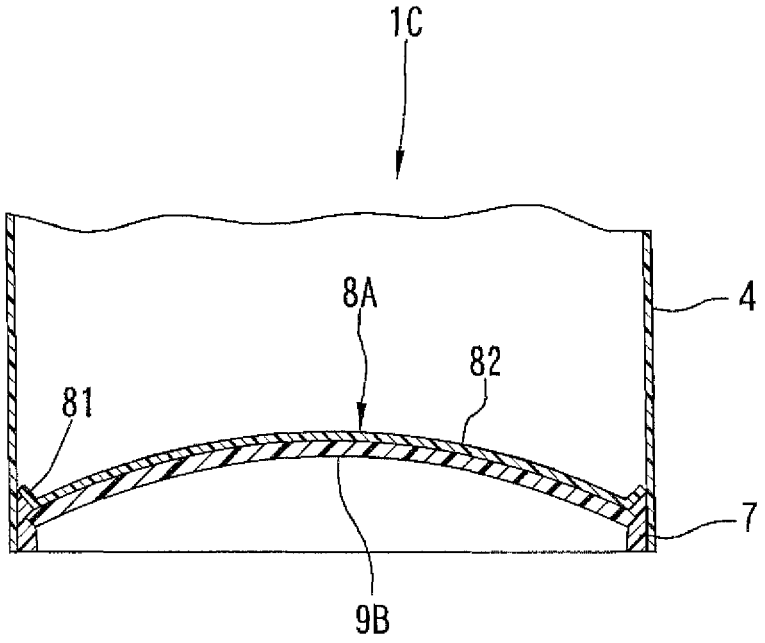
FIG. 7 is a vertical sectional view of a part of a fourth embodiment of the present invention.
Figure 8:
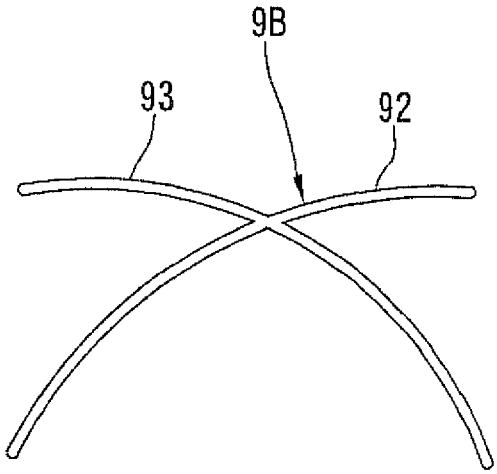
FIG. 8 is a perspective view of a shape-maintaining member used in the fourth embodiment of the present invention.

FIGS. 7 and 8 illustrate a fourth embodiment of the present invention. In a container for granular materials 1C of this embodiment, a shape-maintaining member 9B is used instead of the shape-maintaining member 9. The shape-maintaining member 9B is composed of two integrally formed poles 92, 93. Each of the poles 92, 93 extend in an arcuate configuration. The poles 92, 93 are disposed so as to intersect each other in respective central portions thereof in respective longitudinal directions. The poles 92, 93 are united at the intersecting portion. Opposite end portions of the poles 92, 93 are fitted in the engagement recess 72, thereby the shape-maintaining member 9B fixed to the reinforcement ring 7. It is not required that the shape-maintaining member 9B should be composed of the two poles 92, 93. Alternatively, the shape-maintaining member 9B may be composed of either one of the poles 92, 93. This also applies to fifth to seventh embodiments to be described below.

Figure 9:
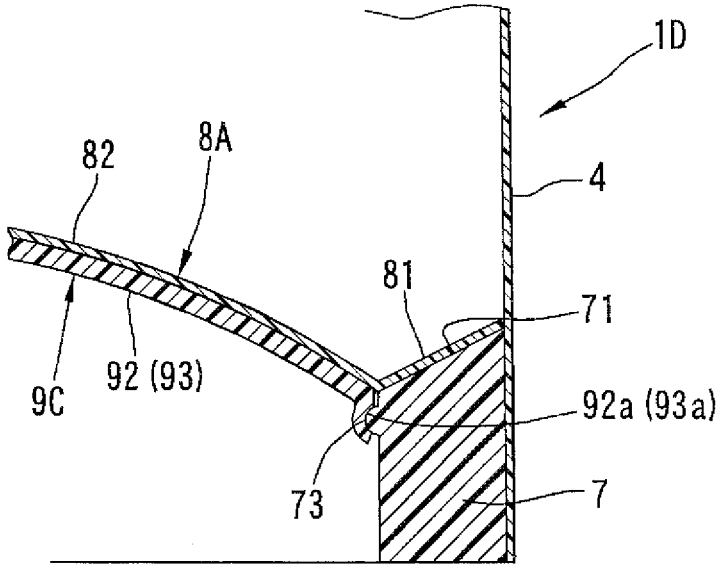
FIG. 9 is an enlarged cross-sectional view of a main portion of a fifth embodiment of the present invention, showing the bottom in an upwardly convex state.
Figure 10:
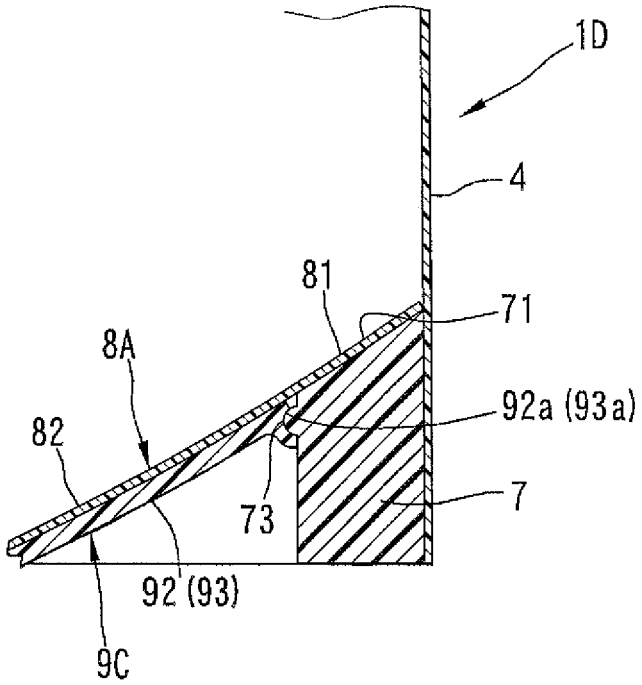
FIG. 10 is an enlarged cross-sectional view of the main portion of the fifth embodiment of the present invention, showing the bottom in a downwardly convex state.

FIGS. 9 and 10 illustrate a fifth embodiment of the present invention. In a container for granular materials 1D of this embodiment, an engagement protrusion 73, instead of the engagement recess 72, is formed in the inner circumferential surface of the reinforcement ring 7. The engagement protrusion 73 has a generally half-circular cross section and extends in an annular configuration. A shape-maintaining member 9C is used as the shape-maintaining means. While the shape-maintaining member 9C is similar to the shape-maintaining member 9B in a general configuration, fitting recesses 92*a*, 93*a* are respectively formed in end surfaces of the poles 92, 93. The engagement protrusion 73 is fitted into the fitting recesses 92*a*, 93*a* such that the engagement protrusion 73 is relatively rotatable about a center line of the engagement protrusion 73 in the vertical direction. The shape-maintaining member 9C is elastically deformable between the downwardly convex state and the upwardly convex state. The shape-maintaining member 9C can be easily deformed by the rotational fitting of the engagement protrusion 73 into the fitting recesses 92*a*, 93*a*. Since the shape-maintaining member 9C is elastically deformable between the downwardly convex state and the upwardly convex state, the shape-maintaining member 9C may be fixed to the under surface of the bottom 8A.

When granular materials are filled into the container 1D, the shape-maintaining member 9C is made to be downwardly convex in advance. The bottom 8A becomes downwardly convex following the shape-maintaining member 9C. Then, after the granular materials are put into the storage part 4, the storage part 4 is vibrated to increase the density of the granular materials. Next, the shape-maintaining member 9C is elastically deformed to be upwardly convex. After that, the upper end opening of the storage part 4 is closed by the seal 5 and the lid 3.

Figure 11:
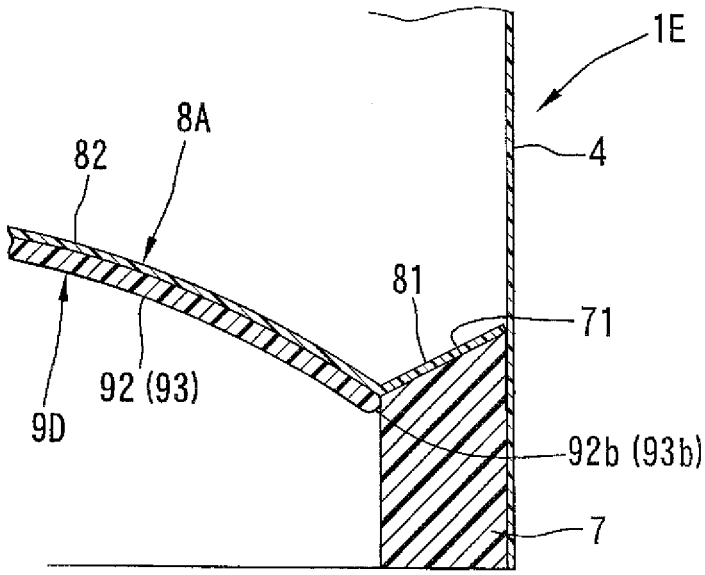
FIG. 11 is an enlarged cross-sectional view of a main portion of a sixth embodiment of the present invention, showing the bottom in an upwardly convex state.
Figure 12:
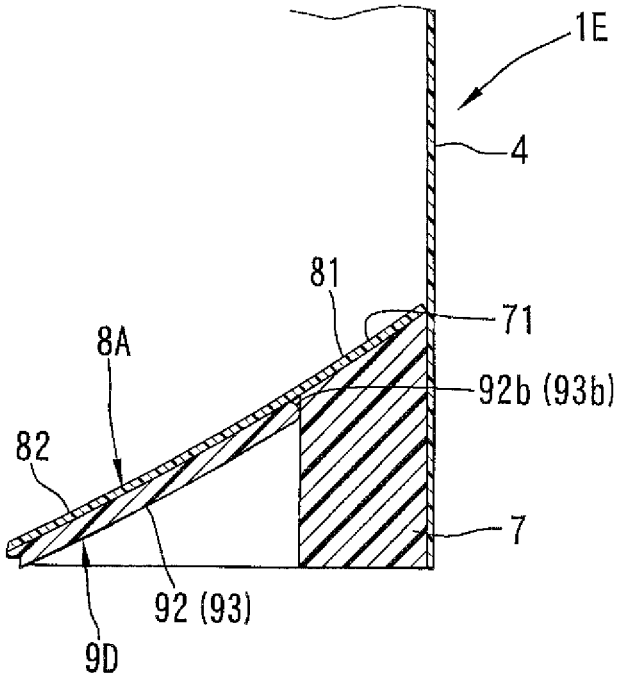
FIG. 12 is an enlarged cross-sectional view of the main portion of the sixth embodiment of the present invention, showing the bottom in a downwardly convex state.

FIGS. 11 and 12 illustrate a sixth embodiment of the present invention. In a container for granular materials 1E of this embodiment, a shape-maintaining member 9D is used. While the shape-maintaining member 9D is similar to the shape-maintaining member 9C in the general configuration and in being elastically deformable between the downwardly convex state and the upwardly convex state, top surfaces of the poles 92, 93 of the shape-maintaining member 9D are fixed to the under surface of the bottom 8A. Generally hemispheroidal abutment portions 92*b*, 93*b* are respectively formed in end surfaces of the poles 92, 93. The abutment portions 92*b*, 93*b* are pressed to contact the inner circumferential surface of the reinforcement ring 7 by own elasticity of the poles 92, 93. Accordingly, when the shape-maintaining member 9D is in the upwardly convex state, the shape-maintaining member 9D biases the bottom 8A upward by its own elasticity and when the shape-maintaining member 9D is in the downwardly convex state, the shape-maintaining member 9D biases the bottom 8A downwardly by its own elasticity. The shape-maintaining member 9D is flipped vertically between the downwardly convex state and the upwardly convex state around points at which the abutment portions 92*b*, 93*b* contact the reinforcement ring 7.

Figure 13:
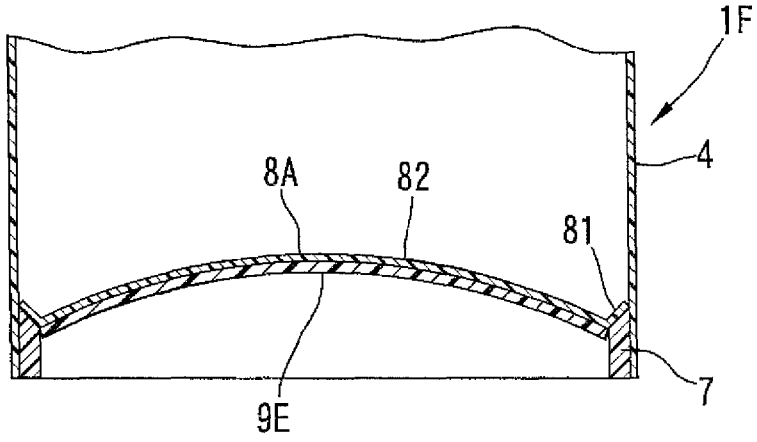
FIG. 13 is an enlarged cross-sectional view of a main portion of a seventh embodiment of the present invention, showing the bottom in an upwardly convex state.
Figure 14:
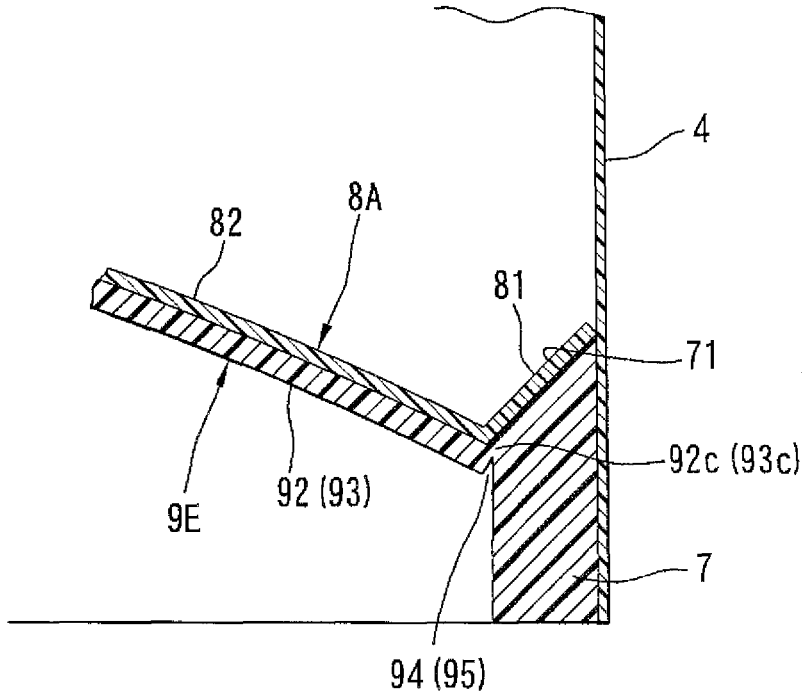
FIG. 14 is an enlarged cross-sectional view of the main portion of the seventh embodiment of the present invention, showing the bottom in an upwardly convex state.

FIGS. 13 and 14 illustrate a seventh embodiment of the present invention. In a container for granular materials IF of this embodiment, a shape-maintaining member 9E is used. The shape-maintaining member 9E is similar to the shape-maintaining members 9C and 9D in that the shape-maintaining member 9E is composed of the two poles 92, 93, that the poles 92, 93 are fixed to the bottom 8A and that the poles 92, 93 can be elastically flipped in the vertical direction. On the other hand, in the shape-maintaining member 9E, opposite end portions of the poles 92, 93 are integrally formed with an upper end portion of the inner circumferential surface of the reinforcement ring 7. Notches 94, 95 are respectively formed in under parts of portions at which the poles 92, 93 and the reinforcement ring 7 are connected. By the formation of the notches 94, 95, thin-walled portions 92*c*, 93*c* are respectively formed in connecting portions connecting the poles 92, 93 and the reinforcement ring 7. This allows the shape-maintaining member 9E to be easily flipped between the downwardly convex state and the upwardly convex state.

Figure 15:
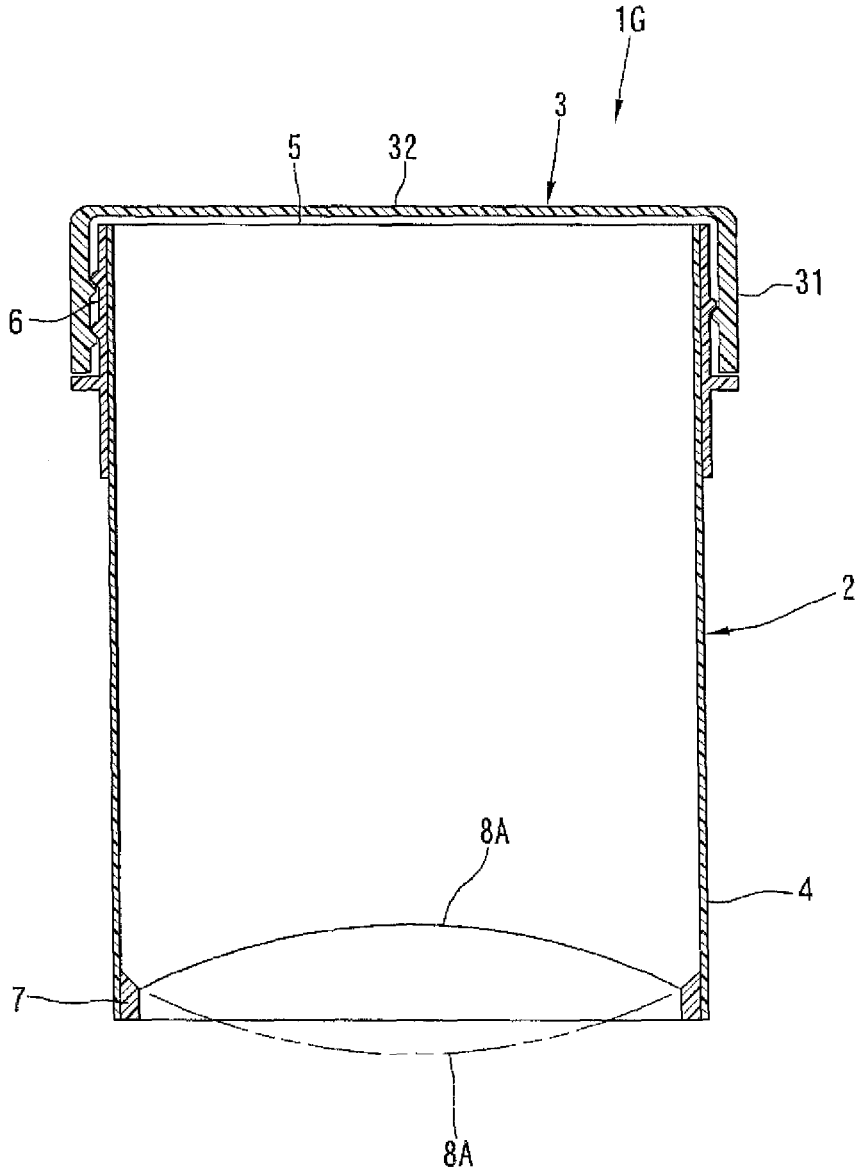
FIG. 15 is a vertical sectional view of an eighth embodiment of the present invention.

FIG. 15 illustrates an eighth embodiment of the present invention. In a container for granular materials 1G of this embodiment, the bottom 8A is not maintained in the upwardly convex state by a member as the shape-maintaining means. Instead, the bottom 8A is maintained in the upwardly convex state by producing a vacuum inside the storage part 4. That is, a negative pressure inside the storage part 4 is used as the shape-maintaining means.

When granular materials are filled into the container 1G, as with the other embodiments mentioned above, a predetermined amount of the granular materials are put into the storage part 4 from the upper end opening of the storage part 4. After that, the storage part 4 is vibrated to increase the density of the granular materials. At this time, the bottom 8A is in the downwardly convex state. After that, air is sucked out of the storage part 4 to form a vacuum. When a pressure inside the storage part 4 becomes lower than a negative pressure of a predetermined magnitude, the bottom 8A is pushed upward by the atmospheric pressure against a weight of the granular materials, and becomes upwardly convex. If a peripheral wall of the storage part 4, particularly a central portion of the peripheral wall in the vertical direction becomes inwardly concave by the negative pressure, visual quality of the container 1G may be degraded. To avoid such degradation, the storage part 4 is made with enough strength not to be deformed until the pressure inside the storage part 4 becomes lower than a negative pressure at which the bottom 8A becomes maximally upwardly convex by a predetermined magnitude. After that, the seal 5 is fixed to the top end surfaces of the storage part 4 and the reinforcement cylinder 6 with the pressure inside the storage part 4 maintained at the negative pressure, and the lid 3 is threadedly secured to the reinforcement cylinder 6.

It is to be understood that the present invention is not limited to the embodiments described above and various modifications may be adopted without departing from the spirit or scope of the invention.

For example, while the container body 2 is vertically disposed in the embodiments described above, the container body 2 may be horizontally disposed. In this case, the opening may be formed in one of the left and right end portions and the bottom 8 may be formed in the other of the left and right end portions.

INDUSTRIAL APPLICABILITY

The storing container according to the present invention may be used as a container for storing granular materials such as tablets of medicine, dietary supplements or the like and powder materials such as microcapsules.

REFERENCE SINGS LIST

1 storing container for granular materials (storing container)
1A storing container for granular materials
1B storing container for granular materials
1C storing container for granular materials
1D storing container for granular materials
1E storing container for granular materials
1F storing container for granular materials
1G storing container for granular materials
2 container body
3 lid
4 storage part
8 bottom
8A bottom
9 shape-maintaining member (shape-maintaining means)
9A shape-maintaining member (shape-maintaining means)
9B shape-maintaining member (shape-maintaining means)
9C shape-maintaining member (shape-maintaining means)
9D shape-maintaining member (shape-maintaining means)
9E shape-maintaining member (shape-maintaining means)

The invention claimed is:

1. A storing container comprising:

a container body comprising a storage part and a bottom, the storage part having an opening in a distal end of the storage part, the bottom closing a basal end portion of the storage part; and a lid closing the opening in the distal end of the storage part, wherein the storage part is made of a plastic film, wherein the bottom is deformable between a first state and a second state, wherein the bottom is convex in a direction from the distal end of the storage part to a basal end of the storage part in the first state, wherein the bottom is convex in a direction from the basal end of the storage part to the distal end of the storage part in the second state, and wherein the storing container further comprises a shape-maintaining means maintaining the bottom in the second state with a force of a predetermined magnitude, wherein the bottom is made of a plastic film, wherein a reinforcement ring is fixed to an inner circumference of the basal end portion of the storage part, an outer circumferential part of the bottom being fixed to an upper part of the reinforcement ring, and wherein the shape-maintaining means is a shape-maintaining member, the shape-maintaining member is a separate part from the bottom and fixed to an inner circumference of the reinforcement ring, the shape-maintaining member being closer to the basal end of the storage part than the bottom, and the bottom is maintained in the second state by an abutment of the shape-maintaining member against a lower surface of the bottom.

2. The Storing container according to claim 1, wherein the shape-maintaining member is deformable between the first state and the second state.

3. The storing container according to claim 1, wherein an outer circumferential part of the shape-maintaining member is engaged with the inner circumferential of the reinforcement ring, thereby the shape-maintaining member being fixed to the reinforcement ring.

4. The storing container according to claim 1, wherein an outer circumferential part of the shape-maintaining member is integrally formed with the inner circumferential of the reinforcement ring, thereby the shape-maintaining member being fixed to the reinforcement ring.

* * * * *